US007985142B2

(12) United States Patent
Lokhorst

(10) Patent No.: US 7,985,142 B2
(45) Date of Patent: Jul. 26, 2011

(54) INDOOR SKI SLOPE

(75) Inventor: Barend Alexander Ernst Lokhorst, Leiden (NL)

(73) Assignee: LF Snowconcepts B.V., Rotterdam (NL)

( * ) Notice: Subject to any disclaimer, the term of this patent is extended or adjusted under 35 U.S.C. 154(b) by 973 days.

(21) Appl. No.: 11/720,813

(22) PCT Filed: Dec. 7, 2005

(86) PCT No.: PCT/NL2005/000840

§ 371 (c)(1),
(2), (4) Date: Jul. 31, 2007

(87) PCT Pub. No.: WO2006/062396

PCT Pub. Date: Jun. 15, 2006

(65) Prior Publication Data

US 2010/0144454 A1 Jun. 10, 2010

(30) Foreign Application Priority Data

Dec. 7, 2004 (NL) ..... 1027682

(51) Int. Cl.
*A63C 19/10* (2006.01)
*A63C 19/00* (2006.01)

(52) U.S. Cl. ..... 472/90; 472/92

(58) Field of Classification Search ..... 472/88–92, 472/94; 52/6, 66–68
See application file for complete search history.

(56) References Cited

U.S. PATENT DOCUMENTS

| | | | | |
|---|---|---|---|---|
| 4,790,531 | A | 12/1988 | Matsui et al. | |
| 4,976,422 | A | 12/1990 | Shimamura | |
| 5,031,832 | A * | 7/1991 | Ratnik et al. | 239/14.2 |
| 5,230,218 | A * | 7/1993 | Clulow | 62/74 |
| 5,327,738 | A * | 7/1994 | Morioka et al. | 62/74 |
| 6,470,631 | B1 * | 10/2002 | Rechsteiner | 52/81.1 |
| 6,488,590 | B2 * | 12/2002 | Katayama | 472/90 |
| 6,634,953 | B1 * | 10/2003 | Czintos | 472/90 |
| 6,789,360 | B2 * | 9/2004 | Silberman et al. | 52/66 |
| 6,851,227 | B1 * | 2/2005 | Schildge, Jr. | 52/66 |
| 6,962,534 | B2 * | 11/2005 | Richter et al. | 472/90 |

FOREIGN PATENT DOCUMENTS

EP 0302556 A1 2/1989

* cited by examiner

*Primary Examiner* — Kien T Nguyen
(74) *Attorney, Agent, or Firm* — Hoffmann & Baron, LLP

(57) ABSTRACT

An indoor ski slope (1) comprises a continuous peripheral wall (2) and a floor (3) which extends obliquely downwards relative to the peripheral wall (2). A roof (5) is arranged on the peripheral wall (2). Furthermore, a layer of snow is provided on the surface of the floor (3), as well as a cooling installation (9) for cooling the floor to a temperature which is suitable for maintaining the layer of snow. The surface of the floor (3) is at least partially curved concavely.

18 Claims, 3 Drawing Sheets

INDOOR SKI SLOPE

CROSS-REFERENCE TO RELATED APPLICATIONS

This application is the National Stage of International Application No. PCT/NL2005/000840, filed Dec. 7, 2005, which claims the benefit of Netherlands Application No. NL 1027682, filed Dec. 7, 2004, the contents of which is incorporated by reference herein.

FIELD OF THE INVENTION

The invention relates to an indoor ski slope, comprising a circumferential peripheral wall, a floor which extends obliquely downwards relative to the peripheral wall, a roof on the peripheral wall, a layer of snow on the surface of the floor, as well as a cooling installation for cooling the floor to a temperature which is suitable for maintaining the layer of snow.

BACKGROUND OF THE INVENTION

A ski slope of this type is generally known. In this case, the floor is substantially horizontal, i.e. on its lateral edges, the floor is delimited by two lateral walls of the circumferential peripheral wall, which extend parallel to one another. The skiers move substantially along a straight line, relative to which they can execute turns.

In most cases, a drag lift is arranged along these lateral walls which takes the skier to the top of the obliquely downwardly sloping floor. Since the skier descends along this straight ski slope parallel to the drag lift, the skiing distance travelled is virtually the same as the distance over which the skier has been dragged up. Consequently, the time period during which the skier is actually skiing is short compared to the time period required to take the skier up. If there is a waiting time for the drag lift, the actual skiing time is reduced further in relative terms.

It is an object of the invention to provide an indoor ski slope, in which the time period during which skiing is actually taking place is increased in relative terms.

This object is achieved according to the invention in that the surface of the floor is at least partially curved concavely. According to the invention, the surface of the floor is at least a corner segment which is curved concavely. As a result thereof, the skiers cannot only move straight down, but can also ski down transversely to the floor. In this way, the skiing distance travelled can be greater than the distance which is travelled with a drag lift along the lateral wall of the floor, so that the actual time skied is relatively longer than with the known straight ski slope.

Another advantage is the more realistic experience which a skier has on the indoor ski slope according to the invention. In contrast to the known two-dimensional ski slope, where skiers have the impression that they are trapped in a kind of "tunnel", the ski slope according to the invention offers a more realistic experience of a ski piste in a skiing resort.

A yet further advantage is that a relatively larger part of the skiing surface is being used. The known straight ski slope is relatively narrow in relation to its length, for example 500 meters long and only 20 meters wide. In this case, a strip of snow of the ski slope along the lateral walls cannot be used since skiing too closely to these lateral walls is unsafe. If the drag lifts are arranged along these lateral walls, a corresponding clear safety zone will have to be provided along these drag lifts. However, the ski slope according to the invention is relatively wide predominantly in its upper region. In this wide region, the clear safety zones only form a small part of the ski slope according to the invention. Therefore, according to the invention, a relatively larger part of the ski slope can be used effectively.

A yet further advantage of the ski slope according to the invention is the improved safety. With the known narrow ski slope, in particular less experienced skiers, who can only make wide turns, are a nuisance to other skiers on the ski slope. This leads to unsafe situations on the known ski slope which may lead to collisions and falls.

In addition, the advanced skier will also want to execute large turns. The so-called "carve ski" is a ski which has a slightly tailored shape in the longitudinal direction. The radius of the outer edge of the carve ski or the snowboard affects the radius of the turn which is performed therewith. If the ski is only slightly tailored, i.e. if the ski is virtually straight, the ski is mainly intended to be used for wide turns, such as occur, for example, in a giant slalom descent. An advanced skier using such skis will also want to make large turns, and in that case can thus also cause accidents.

For safety reasons, the so-called "fun carve ski" cannot really be used to full advantage on a known ski slope either. A fun carve ski is a carve ski having a relatively small radius, thus enabling even turns of 360° to be executed with it.

As the shape of the ski slope according to the invention is curved concavely, a skier can swerve at least in the relatively wide upper region transverse to the direction inclined towards the lowest point without impeding other skiers. On the indoor ski slope according to the invention, there is sufficient space for every skier, thus reducing the risk of collisions.

The safety of the ski slope according to the invention is also improved as the distribution of snow over the floor is less easily disturbed. With the known linear ski slope, the snow will be forced from the centre of the floor to the lateral walls as a result of the skiing. Consequently, ice may form in the centre of the floor which may cause skiers to slip and fall. The floor according to the invention is much wider, so that ice forms less rapidly.

It should be noted that WO 01/05472 discloses an indoor ski slope which is provided with a dome-shaped floor. The dome-shaped floor simulates a hill from the top of which skiers can ski downwards. However, the floor of this indoor ski slope is not curved concavely. Consequently, a skier who is situated on the hill does not have an overview of the ski slope. Since the distance between the roof and the floor is relatively small over the entire ski slope, a skier may furthermore experience a sensation as if he/she is trapped in a tunnel. In addition, the top of the hill will be very busy, which adversely affects safety. According to the invention, each skier has an extensive view of the entire ski slope, which increases safety and provides a virtual open-air skiing experience. The ski slope according to the invention really is three-dimensional.

SUMMARY OF THE INVENTION

In particular, the surface of the floor is at least partially curved concavely in at least two directions. This creates an at least partially bowl-shaped incline, which inter alia provides a good overview of the ski slope.

In order to increase the abovementioned advantages, the ski slope may have a length of at least 300 meters and a width of at least 100 meters.

The angle between the lateral walls of the ski slope according to the invention can be of various designs. For example, the floor has lateral edges which extend at an angle of substantially at least 90° or 180° relative to one another. If the angle is larger, the freedom of movement of the skier on the ski slope according to the invention increases, thus reducing the risk of accidents and making the skiing experience more realistic.

In one preferred embodiment of the invention, the concavely curved surface of the floor is substantially bowl-shaped, that surface having a circumferential top edge and extending obliquely downwards relative to this continuous top edge towards a central valley region. In this case, the indoor ski slope forms a stadium, in which the peripheral wall is designed to be continuous and the floor extends over 360°. In this case, even ski trips over the ski slope according to the invention are possible, for example by following a spiral-shaped track on the floor. In addition, the safety zones along the lateral walls are redundant, as the ski slope is not delimited by lateral edges, which makes it possible to use the entire surface area of the floor.

According to the invention, it is possible for the angle of inclination of the obliquely downwardly extending surface to vary with the peripheral position on that surface. For example, the bowl-shaped surface is divided into several sections, which merge smoothly into one another in the peripheral direction, the angle of inclination of a first section of the surface being smaller than the angle of inclination of a second section of the surface in order to form pistes with a varying degree of difficulty. The first section, for example, forms a so-called "blue" piste, while the second section, for example, forms a so-called "red" piste. A skier who is on this ski slope can easily move from the blue piste to the red piste.

In a particular embodiment according to the invention, the bowl-shaped surface is divided into at least four sections, which merge smoothly into one another in the peripheral direction, the surface of the first section having a first angle of inclination, and the surface of the second and third sections each having a second angle of inclination, and the surface of the fourth section having a third angle of inclination, the first angle of inclination being smaller than the second angle of inclination, and the second angle of inclination being smaller than the third angle of inclination. The first section in this case forms a "blue" piste, the second and third sections each form a "red" piste and the fourth section forms a "black" piste.

The floor surface can be divided in various ways. In one suitable division, for example, the first section substantially comprises 180° of the bowl-shaped surface, and the second, third and fourth sections each comprise substantially 60° of the bowl-shaped surface. This division is an approximate reflection of the average abilities of skiers who use indoor ski slopes.

According to the invention, it is possible that the bowl-shaped forms a substantially asymmetrical piano-concave shape.

According to the invention, it is furthermore possible to provide the surface, at least locally, with a structure, for example a local dome-shaped elevation, a ski jump, a bulge, a so-called buckel piste, etcetera. With such an embodiment, the large width which is possible is in turn an advantage. After all, less experienced skiers who want to avoid such a structure can easily do so, as a large and wide area of the slope is still available to them. With the state of the art, there might only be very limited space left for the inexperienced skiers.

Furthermore, the top of the surface of the floor may be flattened in order to form a horizontal upper ring. From this flat upper ring, a skier can easily oversee the entire bowl-shaped surface.

In one embodiment of the invention, the roof is provided with solar cells for generating energy. The energy which is generated can be supplied to the cooling installation.

According to the invention, it is possible for the roof to be moved between an open position, in which the ski slope is exposed to environmental influences, such as precipitation, and a closed position, in which the ski slope is sealed off from the environment. If the weather conditions are favourable, the roof may be opened. In snowy areas, any snow falling into the indoor ski slope may be collected, which makes a saving in the production of snow or artificial snow possible. In addition, skiing in the open air, either with or without falling snow, will make the skiing experience even more realistic.

In particular, the ski slope according to the invention comprises an artificial ski slope, comprising an artificial structure with a floor surface. According to the invention, the floor surface in this case has a shape as described above. A huge advantage of an artificial ski slope is the complete freedom of design, it being possible in principle, for example, to choose the dimensions and shape freely, and it likewise being possible to choose a favourable location with suitable infrastructure and other provisions etcetera. Incidentally, alternatively, it is also possible to use a natural or otherwise already existing formation which approaches the shape according to the invention. Following some modifications, a ski slope according to the invention can be built on top of such a formation. Because of the freedom of design, the artificial, constructed ski slope is preferred in this case.

Various kinds of lifts may be provided in order to transport the skiers from the central valley region to the top of the floor. The ski slope may for example be provided with several ski lifts for transporting people from the central valley region to the top of the floor, these lifts being distributed over the bowl-shaped surface at a distance from one another. It is also possible to provide at least one lift which extends upwards from a height level along the vertical peripheral wall to the top of the floor.

BRIEF DESCRIPTION OF THE DRAWINGS

The invention will now be described in more detail with reference to a in the drawing, in which.

DETAILED DESCRIPTION OF PREFERRED EMBODIMENTS

Figure 1:
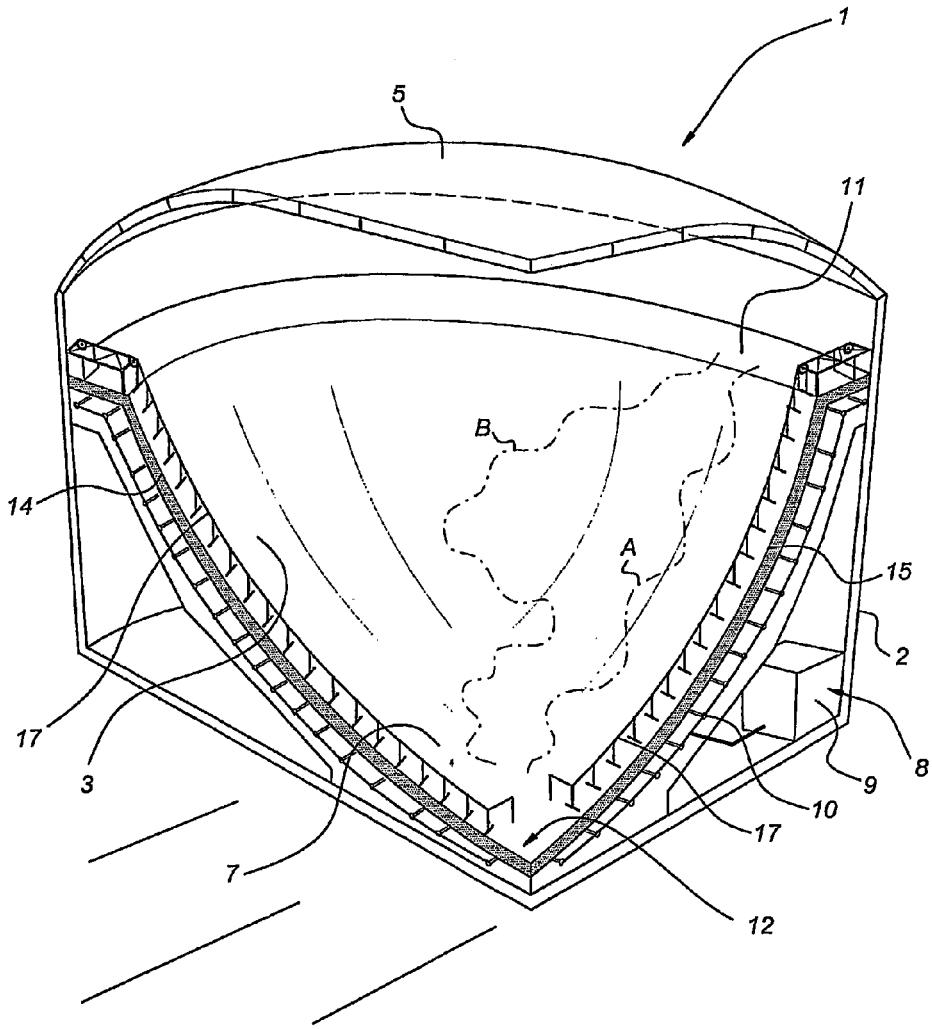
FIG. 1 shows a diagrammatically cut-away and perspective view of a first embodiment of an indoor ski slope according to the invention.

The indoor ski slope shown in FIG. 1 is denoted overall by reference numeral 1. The ski slope 1 comprises a continuous peripheral wall 2, as well as a floor 3 which extends obliquely downwards relative to the peripheral wall 2. Furthermore, the ski slope 1 is provided with a roof 5 which rests on the peripheral wall 2. Although the ski slope according to the invention is shown in cut-away view in FIG. 1, the roof 5 and the peripheral wall 2 together form a closed space.

The floor 3 is provided with a layer of artificial snow or snow 7 which is generated, for example, by a snow machine. The floor 3 is cooled to a temperature suitable for maintaining the layer of snow 7 by a cooling installation 8. To this end, the cooling installation 8 is provided with a system of coolant lines 10 which extend from a cooling unit 9 to various locations under the floor 3. The coolant lines 10 extract heat from the floor 3, so that the temperature of the snow remains at between −5° C. and −9° C. This temperature is advantageous for the quality of the snow. The cooling installation 9 also comprises one or more cooling fan devices (not shown) which blow cold air into the interior of the ski slope. Consequently, the air in the indoor ski slope remains at the desired cold temperature.

The floor 3 is delimited by two lateral edges 14, 15. In this exemplary embodiment, the lateral edges 14, 15 of the floor 3 are at an angle of approximately 90° relative to one another. On both lateral edges 14, 15, a drag lift 17 is provided which takes skiers to the top of the floor 3. This top of the floor 3 has a flattened edge area 11 to allow skiers to stand still without much effort, before they descend over the floor 3. From the flattened edge area 11, the floor 3 extends obliquely downwards to a central valley region 12.

The surface of the floor 3 is partially curved concavely, at least in the peripheral direction. As a result, a skier can not only ski in a direct line from the edge area 11 to the central valley region (see arrow A), but can also deviate therefrom in the transverse direction, for example in accordance with arrow B. In accordance with track B, the skier continues to descend as a result of the concavely shaped curve of the surface of the floor 3.

The angle between the lateral edges 14, 15 of the floor 3 may also be, for example, approximately 180°, i.e. when viewed from above, the ski slope essentially forms a semi-oval or semicircle (not shown). Consequently, an even greater freedom of movement of the skiers is possible, compared to the ski slope shown in FIG. 1. As the angle between the lateral edges 14, 15 increases further, a skier will be able to make longer ski trips by moving in the peripheral direction of the indoor ski slope.

Figure 2:
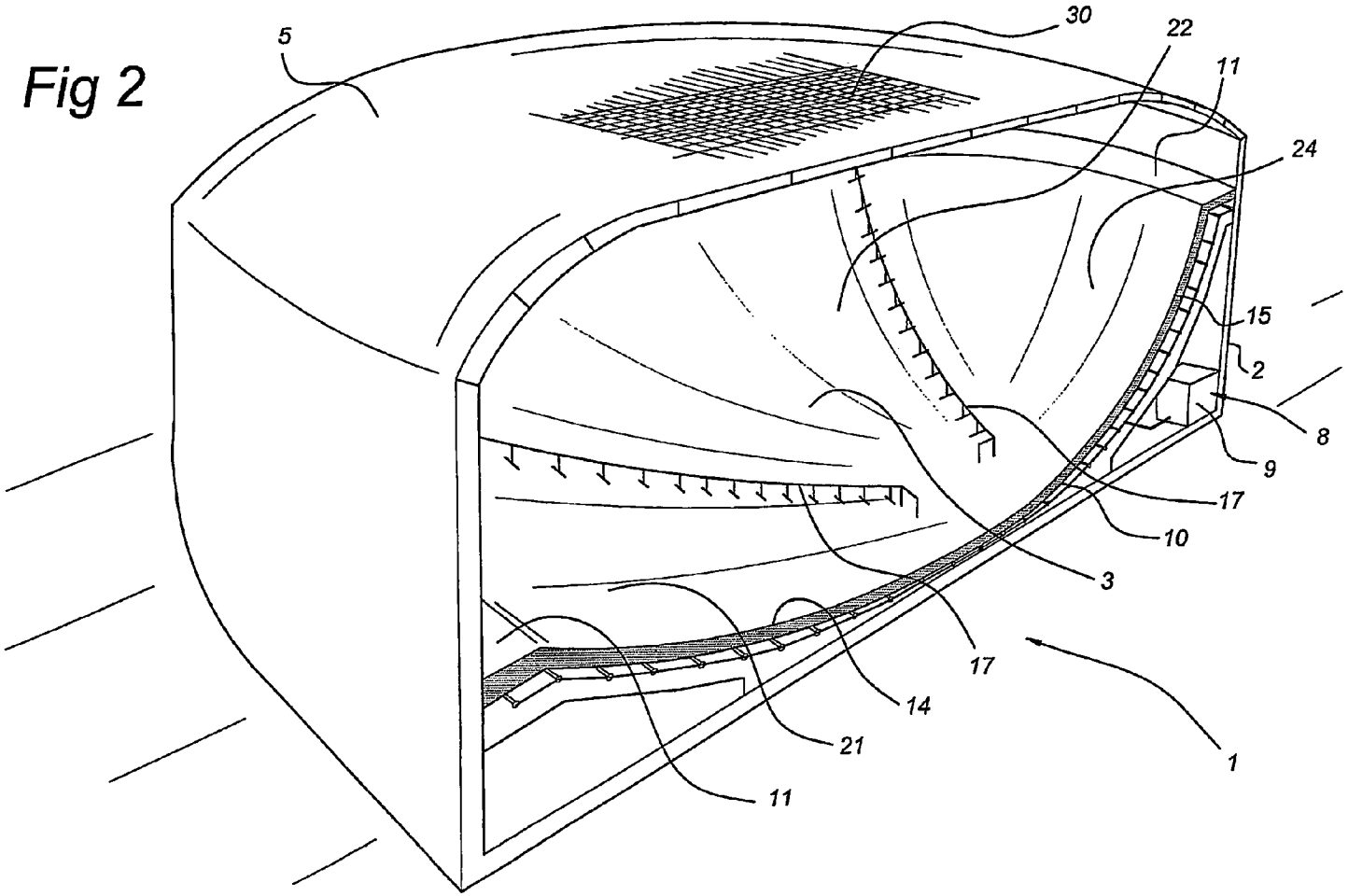
FIG. 2 shows a diagrammatically cut-away and perspective view of a second embodiment of an indoor ski slope according to the invention.
Figure 3:
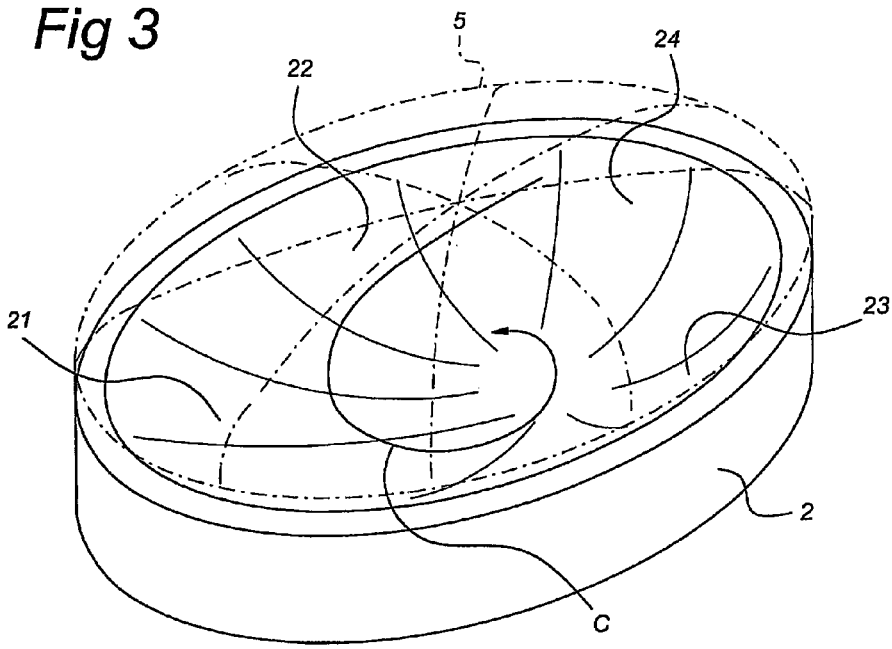
FIG. 3 shows a diagrammatic perspective view of the ski slope shown in FIG. 2.
Figure 4:
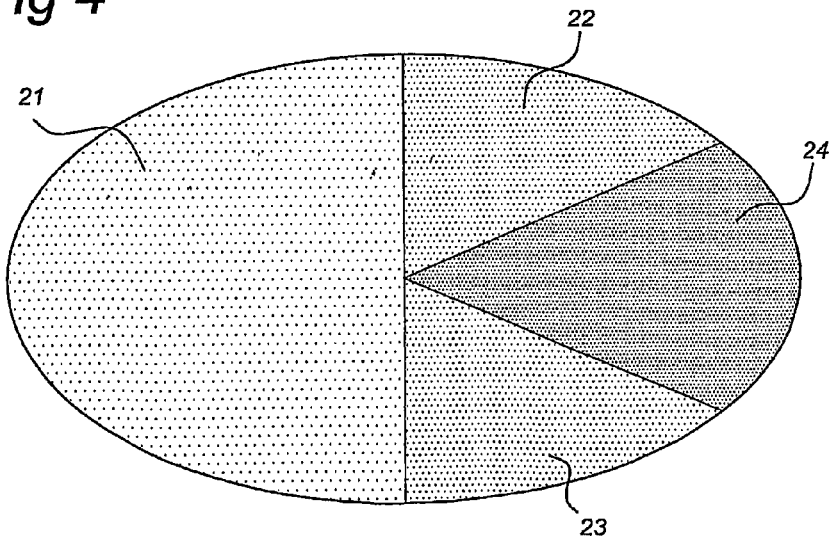
FIG. 4 shows a diagrammatic top view of the ski slope shown in FIG. 2.

FIGS. 2-4 show a preferred embodiment of the invention, in which identical components are denoted by the same reference numerals. The indoor ski slope 1 according to FIGS. 2-4 comprises a stadium, which is, for example, 400-600 meters, e.g. 500 meters, long, and 200-400 meters, e.g. 300 meters, wide. The continuous peripheral wall 2 of the stadium is closed. The height of the peripheral wall 2 is, for example, somewhere between 60-100 meters. FIG. 2 shows only half of the stadium, whereas FIG. 3 shows the entire stadium 1. In a stadium of this type, it is even possible to make a ski trip (see arrow C).

The floor 3 is surrounded by this closed peripheral wall 2. In this case, the surface of the floor 3 is bowl-shaped. The inclination of this surface depends on the position on the floor 3, which forms sections with different degrees of difficulty. These sections merge smoothly into one another.

As is most clearly illustrated in FIG. 4, the bowl-shaped surface of the floor 3 comprises four sections, 21, 22, 23, 24, which merge smoothly into one another in the peripheral direction. The surface of the first section 21 has a first angle of inclination, which is approximately 10°. Such a floor section 21 corresponds to a co-called "blue" piste, which is mainly intended for beginner skiers. The first section 21 essentially comprises half the total floor surface. The second section 22 and the third section 23 are located on either side of the first section 21, respectively. These sections 22, 23 have a second angle of inclination of essentially 15°, which corresponds to a so-called "red" piste. A red piste requires more skiing experience than a blue piste. Each of the sections 22, 23 forms about ⅙ of the total floor surface.

The fourth section 24, which is located between the sections 22, 23 in turn is steeper than the sections 22, 23. The fourth section has an angle of inclination of, for example, 20° or more. As a result, a so-called "black" piste is created which is challenging even for seasoned skiers and competitive skiers. The fourth section 24 comprises essentially ⅙ of the total floor surface.

As the sections 21, 22, 23, 24 merge smoothly into one another, the bowl-shaped surface of the floor 3 forms an asymmetrical plano-concave shape. Of course, the angles of inclination of the sections 21, 22, 23, 24 may differ from the values given above, and moreover, the division of these sections 21, 22; 23, 24 over the total floor surface may differ.

Solar cells 30 generating energy to be supplied to the cooling installation 8 are located on the roof 5. The cooling installation 8 comprises a cooling unit 9 and a branch system of coolant lines 10 which are evenly distributed under the floor 3. The coolant lines 10 extract heat from the floor 3, so that the temperature of the snow on the floor 3 remains at a temperature of between −5° C. and −9° C. At this temperature, the snow remains in optimum condition. The cooling installation 8 furthermore comprises one or more cooling fan devices (not shown) which blow cool air into the interior of the ski slope 1. Consequently, the air in the indoor ski slope 1 also remains at the desired cold temperature.

Various drag lifts 17 are provided distributed over the floor 3. Other ski lifts may also be provided, such as a chair lift, a belt lift or a gondola. In addition, a vertical lift shaft may be provided on the peripheral wall 2, with a lift which takes skiers directly to the flattened edge area of the floor 3.

In order to make the ski slope more realistic, it is possible to provide rocks, trees, a small stream, a waterfall or the like on the floor 3 (not shown). It is also possible to erect guest facilities (not shown), in which the skiers can rest, on the floor 3, i.e. on the piste.

There is sufficient space underneath the floor 3 for ancillary activities, such as conference facility, a shopping centre and various guest facilities. It is also possible to provide housing in the space under the floor. Furthermore, it is possible to incorporate a tennis court and/or driving range for golfers (not shown) in the indoor ski slope according to the invention.

As a result of the dimensions of the stadium and the shape of the surface of the floor 3, a skiing valley is created which accurately replicates the skiing conditions in skiing resorts. Therefore, skiers will have a realistic skiing experience in the indoor ski slope according to the invention.

Although the description of the exemplary embodiment shown in the figures mentions only a ski slope for skiers, it is obvious that the ski slope can also be used for other mountain and winter sport, such as skating, ice climbing, bobsleighing and cross-country skiing.

What is claimed is:

1. Indoor ski slope, comprising a circumferential peripheral wall, a floor which extends obliquely downwards relative to the peripheral wall, a roof on the peripheral wall, a layer of snow on the surface of the floor, as well as a cooling installation for maintaining the layer of snow, wherein the surface of the floor is at least partially curved concavely in two directions, and wherein the surface is divided into several sections, which merge smoothly into one another in the peripheral direction, the angle of inclination of a first section of the surface being smaller than the angle of inclination of a second section of the surface in order to form pistes with a varying degree of difficulty.

2. Ski slope according to claim 1, in which the ski slope has a length of at least 300 meters and a width of at least 100 meters.

3. Ski slope according to claim 1, in which the floor has lateral edges which extend at an angle of at least 90° relative to one another.

4. Ski slope according to claim 1, in which the floor has lateral edges which extend at an angle of at least 180° relative to one another.

5. Ski slope according to claim 1, in which the concavely curved surface of the floor is substantially bowl-shaped, that surface having a circumferential top edge and extending obliquely downwards relative to this continuous top edge towards a central valley region.

6. Ski slope according to claim 5, in which the angle of inclination of the obliquely downwardly extending surface varies with the peripheral position on that surface.

7. Ski slope according to claim 5, in which the bowl-shaped surface is divided into at least four sections, which merge smoothly into one another in the peripheral direction, the surface of the first section having a first angle of inclination, and the surface of the second and third sections each having a second angle of inclination, and the surface of the fourth section having a third angle of inclination, the first angle of inclination being smaller than the second angle of inclination, and the second angle of inclination being smaller than the third angle of inclination.

8. Ski slope according to claim 7, in which the first section substantially comprises 180° of the bowl-shaped surface, and in which the second, third and fourth sections each comprise substantially 60° of the bowl-shaped surface.

9. Ski slope according to claim 5, in which the bowl-shaped surface forms a substantially asymmetrical plano-concave shape.

10. Ski slope according to claim 1, in which the top of the surface of the floor is flattened in order to form a horizontal upper ring.

11. Ski slope according to claim 1, in which the roof is provided with solar cells for generating energy.

12. Ski slope according to claim 1, in which the roof can be moved between an open position, in which the ski slope is exposed to environmental influences, such as precipitation, and a closed position, in which the ski slope is sealed off from the environment.

13. Ski slope according to claim 1, in which at least one snow machine for producing snow is provided on the floor so as to be displaceable.

14. Ski slope according to claim 1, in which the ski slope is provided with several ski lifts for transporting people from the central valley region to the top of the floor, these lifts being distributed over the floor surface at a distance from one another.

15. Ski slope according to claim 1, in which at least one lift is provided which extends upwards from a height level along the vertical peripheral wall to the top of the floor.

16. Ski slope according to claim 1, in which the cooling installation is constructed for cooling the floor to a temperature which is suitable for maintaining the layer of snow.

17. Indoor ski slope, comprising a circumferential peripheral wall, a floor which extends obliquely downwards relative to the peripheral wall, a roof on the peripheral wall, a layer of snow on the surface of the floor, as well as a cooling installation for maintaining the layer of snow, wherein the surface of the floor is at least partially concavely, wherein the concavely curved surface of the floor is substantially bowl-shaped, that surface having a circumferential top edge and extending obliquely downwards relative to this continuous top edge towards a central valley region, and wherein the bowl-shaped surface is divided into at least four sections, which merge smoothly into one another in the peripheral direction, the surface of the first section having a first angle of inclination, and the surface of the second and third sections each having a second angle of inclination, and the surface of the fourth section having a third angle of inclination, the first angle of inclination being smaller than the second angle of inclination, and the second angle of inclination being smaller than the third angle of inclination.

18. Ski slope according to claim 17, in which the first section substantially comprises 180° of the bowl-shaped surface, and in which the second, third and fourth sections each comprise substantially 60° of the bowl-shaped surface.

* * * * *